United States Patent [19]

Nyegaard

[11] 4,052,147

[45] Oct. 4, 1977

[54] BURNER HEAD IN AN OIL BURNER

[76] Inventor: Jens Nyegaard, Larviksveien 20, 3290 Stavern, Norway

[21] Appl. No.: 595,433

[22] Filed: July 14, 1975

[30] Foreign Application Priority Data

July 15, 1974 Norway ..... 742576

[51] Int. Cl.[2] ..... F23D 13/40

[52] U.S. Cl. ..... 431/354

[58] Field of Search ..... 431/183, 265, 354

[56] References Cited

U.S. PATENT DOCUMENTS

| | | | |
|---|---|---|---|
| 1,659,573 | 2/1928 | Lalor | 431/354 |
| 2,325,893 | 8/1943 | Vollmer | 431/265 |
| 2,531,538 | 11/1950 | Smith | 431/265 X |
| 2,974,485 | 3/1961 | Schiefer | 60/39.65 |

*Primary Examiner*—Robert G. Nilson

*Attorney, Agent, or Firm*—Young & Thompson

[57] ABSTRACT

A burner head in a burner, which head comprises an air supply tube, a turbulator mounted in the said tube and having an oil nozzle arranged in the center line of the burner, wherein a ring element is arranged in the forward part of the air supply tube, parallel with and at a distance from the forward end of the turbulator.

5 Claims, 2 Drawing Figures

BURNER HEAD IN AN OIL BURNER

Figure 1:
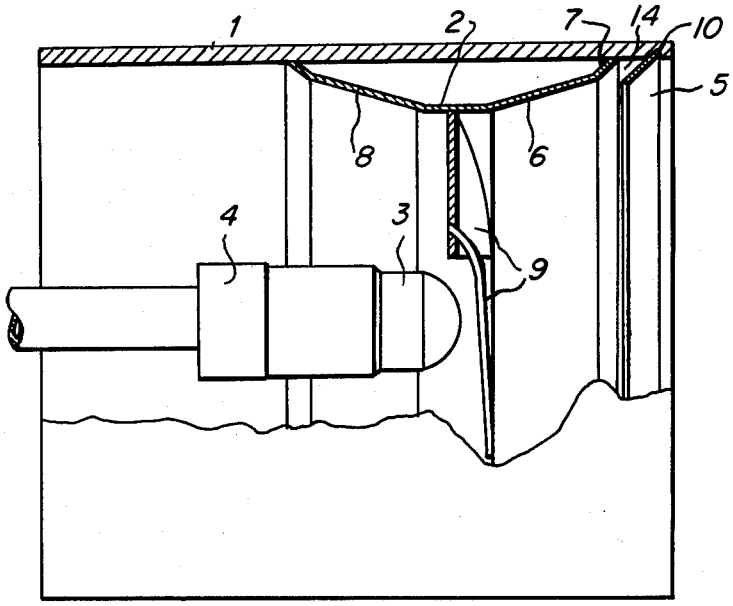

The invention relates to the burner head in an oil burner, which burner head comprises an air supply tube, a turbulator mounted in the said tube and having an oil nozzle arranged in the centerline of the burner. In a modified embodiment a secondary air chamber is arranged between the air supply tube and the turbulator. The secondary air chamber is supplied with air at its trailing end and the air goes out preferably through an annular slot at the forward end of the said chamber. The turbulator has a conical flaring forward end whereas its trailing end is adapted for mounting in the air supply tube. A cylindrical part of the turbulator is provided with vanes or fins surrounding a nozzle holder and the said oil nozzle.

In a known construction an air choke means in the form of oblique fins is arranged. This air choke means gives the combustion air a turbulent movement so that air is mixed with the atomized oil from the oil nozzle. The atomized oil however, contains oil particles which are not totally combusted and therefore causes soot, which represents a problem, especially in the starting phase. Problems arise also in connection with nozzles which are more or less blocked so that the atomizing pattern is disturbed. One has tried to avoid such formation of soot by adding extra air but without therby being able to avoid sooting.

In the Swedish Pat. No. 336,867 a burner head is described in which one tries to solve the problem by flaring the outer part of the turbulator housing outwardly and in this part arrange a series of holes through which a secondary air stream is directed inwardly towards the center line of the burner in order to bring oil droplets into the flame. A further improvement is suggested in the publicly available Norwegian Pat. No. 131,770, wherein the secondary air chamber ends in an annular slot, thereby establishing an air layer which entrains residual oil particles and establishes a very good after-combustion.

In spite of the good results achieved the prior solutions nevertheless does not avoid all soot formation, especially when oil nozzles with a bad spreading pattern are used.

The invention therefore provides a burner head comprising an air supply tube, a turbulator mounted in the said tube and having an oil nozzle arranged in the center line of the burner, wherein a ring element is arranged in the forward part of the air supply tube, parallel with and at a distance from the forward end of the turbulator, which ring element directs swirling air inwardly towards the center line of the burner.

The peripheral air is slowed down by the ring element and directed backwards towards the oil nozzle and the flame and entrains thus in an effective way all residual oil particles, thereby enabling a total combustion of the oil. The result is a very stale and effective combustion.

In fact the combustion is so good that the use of secondary air may be abandoned. This enables the use of a more simple and cheaper construction than as in the said patent publications. In some cases, however, it may be of advantage to enhance the peripheral air stream and a secondary air chamber may then be used, for instance as disclosed in the said Norwegian Pat. No. 131,770.

In the drawing is, in

FIG. 1 disclosed a preferred embodiment of the invention, shown partly in section.

Figure 2:
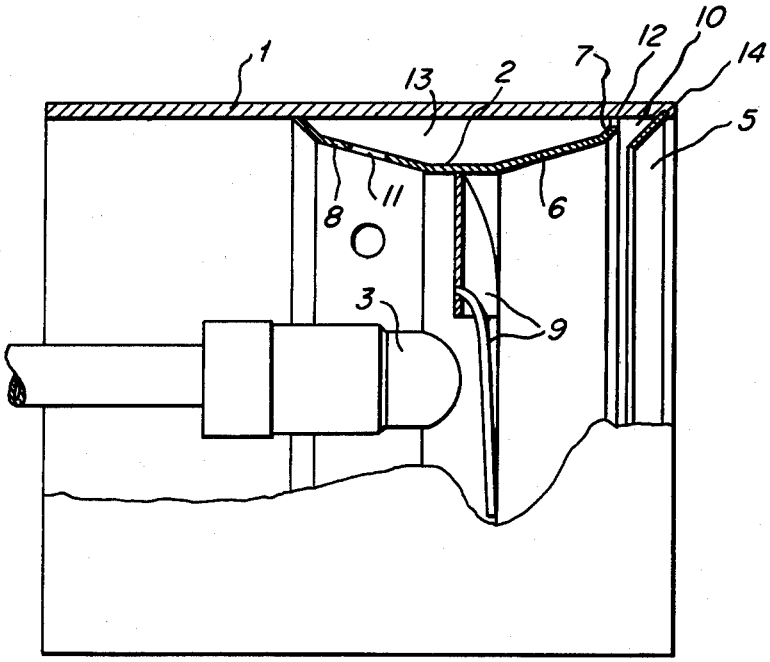

FIG. 2 discloses a modified embodiment also partly in section.

The burner head comprises an air supply tube 1, wherein a turbulator 2 is mounted. In the turbulator an oil nozzle 3 and a nozzle holder 4 are centrally arranged.

One end of the air supply tube is calibrated for the mounting in a ventilator housing (not shown) whereas the other end has a slot 14 wherein a ring element 5 is mounted. The turbulator 2 is mainly cylindrical, with the forward end 6 flaring conically outwards. This conical end 6 ends in a shorter and more steeply flaring part 7. The trailing end of the turbulator has a neck portion 8 which may have approximately the same form as the forward end of the turbulator. In the turbulator 2 are mounted vanes or fins 9. The fins are overlapping each other, thus forming air slots. The fins 9 may be stamped out of a plate and mounted in the turbulator 2. Centrally a circular or polygonal hole is formed.

Between the turbulator part 7 and the ring element 5 a chamber 10 is formed. Peripheral air flowing along the wall is pressed into the chamber 10, turns and is by means of the ring element 5 directed into the flame. The direction of the air layer depends on the form and the angle of the forward part 7 and of the ring element 5. The turbulator body 2, 6, 7, 8 may be displaceable in order to vary the size of the chamber 10 in accordance with the oil quantity used. A plurality of grooves 14, of which only one is shown in FIG. 1, may be provided in order to make it possible to displace the ring element 5. the ring element may also be made variable in other ways. The oil nozzle 3 may also be regulable relative the turbulator.

In order to enhance the air layer which is directed into the flame the turbulator part 8 may have a series of holes 11 and a slot 12 between the turbulator part 7 and the air supply tube 1, as disclosed in FIG. 2. In the secondary air chamber 13 air is in that case compressed and pressed out through the slot 12. The quantity of secondary air may be regulated by a regulation of the slot area 12 or by a regulation of the areas of the holes 11. The holes 11 may for instance have a damper which can cover the holes more or less.

In use the air is pressed through the air supply tube 1 and between the fins 9. A rotary motion is induced to the air flow and an intimate mixture of oil droplets from the oil nozzle and the air is obtained. The air which by means of the ring element 5 is pressed into the flame entrains residual oil particles and results in a total combustion of the mixture, thus giving a stable and effective burning.

The ring element 5 has preferably the disclosed conical form, being directed against the direction of flow through the burner head, and being arranged parallel to the forward end 7 of the turbulator. Other angles are of course possible and the distance between the turbulator end 7 and the ring element 5 may be varied depending on the capacity of the burner.

Having described my invention, I claim:

1. A burner head in a burner, which head comprises an air supply tube, a turbulator mounted in the said tube and having an oil nozzle arranged in the center line of the burner, wherein a ring element is arranged in the forward part of the air supply tube at a distance from the forward end of the turbulator, said ring element being conical and converging against the flow direction in the burner head and forming with the adjacent inner peripheral wall of the burner head a chamber which is closed in the direction of air flow along said peripheral wall, whereby air that flows along said peripheral wall is pressed into said chamber and turns and by means of said ring element is directed into the burner flame.

2. A burner head as in claim 1, wherein the distance between the said forward end of the said turbulator and the said ring element may be varied.

3. A burner head as in claim 1, wherein the said forward end of the said turbulator is flaring outwardly more steeply than the middle part of the said turbulator.

4. A burner head as in claim 1, wherein the said ring element and the said forward end of the said turbulator have the same conicity.

5. A burner head as in claim 1, there being a secondary air chamber between said air supply tube and said turbulator, the forward end of the said chamber having an annular slot opening into the area behind the said ring element.

* * * * *